US011462371B2

(12) United States Patent
Yen

(10) Patent No.: US 11,462,371 B2
(45) Date of Patent: Oct. 4, 2022

(54) KEY STRUCTURE

(71) Applicant: LITE-ON TECHNOLOGY CORPORATION, Taipei (TW)

(72) Inventor: Ming-Fu Yen, Taipei (TW)

(73) Assignee: LITE-ON TECHNOLOGY CORPORATION

( * ) Notice: Subject to any disclaimer, the term of this patent is extended or adjusted under 35 U.S.C. 154(b) by 0 days.

(21) Appl. No.: 17/364,478

(22) Filed: Jun. 30, 2021

(65) Prior Publication Data

US 2022/0044888 A1 Feb. 10, 2022

Related U.S. Application Data

(60) Provisional application No. 63/063,457, filed on Aug. 10, 2020.

(30) Foreign Application Priority Data

Jun. 4, 2021 (CN) ..... 202110623489.8

(51) Int. Cl.
*H01H 13/705* (2006.01)
*H01H 13/83* (2006.01)

(52) U.S. Cl.
CPC ..... *H01H 13/705* (2013.01); *H01H 13/83* (2013.01)

(58) Field of Classification Search
CPC ..... H01H 13/705; H01H 13/83; H01H 3/60; H01H 2219/064; H01H 2221/062; H01H 3/125; H01H 13/702; H01H 13/7065; H01H 13/86; H01H 3/12; H01H 3/122; H01H 13/70; H01H 13/703; H01H 13/704; H01H 13/85; H01H 2209/068; H01H 2227/004; G10K 11/16
See application file for complete search history.

(56) References Cited

U.S. PATENT DOCUMENTS

| | | | | |
|---|---|---|---|---|
| 9,837,221 | B2 * | 12/2017 | Liao | H01H 3/125 |
| 10,032,575 | B2 * | 7/2018 | Chen | H01H 13/14 |
| 10,401,970 | B1 * | 9/2019 | Chen | H01H 13/705 |
| 2014/0034467 | A1 * | 2/2014 | Chou | H01H 3/125 200/5 A |

* cited by examiner

*Primary Examiner* — Lheiren Mae A Caroc
(74) *Attorney, Agent, or Firm* — Innovation Counsel LLP

(57) ABSTRACT

A key structure is provided. The key structure includes a base plate, a membrane switch circuit, a key cap and a balance bar. The base plate includes a mounting portion. The membrane switch circuit is arranged on the base plate. The key cap is disposed above the membrane switch circuit. The balance bar is arranged between the base plate and the key cap. The balance bar includes a rod body and a first link part, the rod body is connected to the key cap, and the first link part is pivotally arranged corresponding to the mounting portion and connected to the base plate. An opaque area is formed in the overlap range of the orthographic projection of the membrane switch circuit and the key cap.

15 Claims, 9 Drawing Sheets

KEY STRUCTURE

This application claims the benefit of U.S. provisional application Ser. No. 63/063,457, filed Aug. 10, 2020, and People's Republic of China application Serial No. 202110623489.8, filed Jun. 4, 2021, the disclosure of which is incorporated by reference herein in its entirety.

TECHNICAL FIELD

The disclosure relates to a key structure.

BACKGROUND

The existing key structure generally includes standard keys and special keys (for example, "Caps Lock", space key and other function keys). The length of the key cap of the special keys is mostly longer than other keys. Therefore, it is necessary to add a balance bar to make the whole body of the key cap can move down in a balanced manner when being pressed. However, the balance bar easily comes into contact with the base plate, causing unnecessary noise. In addition, there is a gap between the edge of the key cap and the top surface of the membrane circuit board, so that the light projected by the backlight module to the key cap is easily emitted through the gap, resulting in an increase of light leakage of the light-emitting keyboard structure.

SUMMARY

The disclosure relates to a key structure that can improve the above-mentioned existing problems.

According to one aspect of the disclosure, a key structure is provided. The key structure includes a base plate, a membrane switch circuit, a key cap and a balance bar. The base plate includes a mounting portion. The membrane switch circuit is arranged on the base plate. The key cap is disposed above the membrane switch circuit. The balance bar is arranged between the base plate and the key cap. The balance bar includes a rod body and a first link part, the rod body is connected to the key cap, and the first link part is pivotally arranged corresponding to the mounting portion and connected to the base plate. An opaque area is formed in the overlap range of the orthographic projection of the membrane switch circuit and the key cap.

Other objects, features, and advantages of the invention will become apparent from the following detailed description of the preferred but non-limiting embodiments. The following description is made with reference to the accompanying drawings.

Figure 1A:
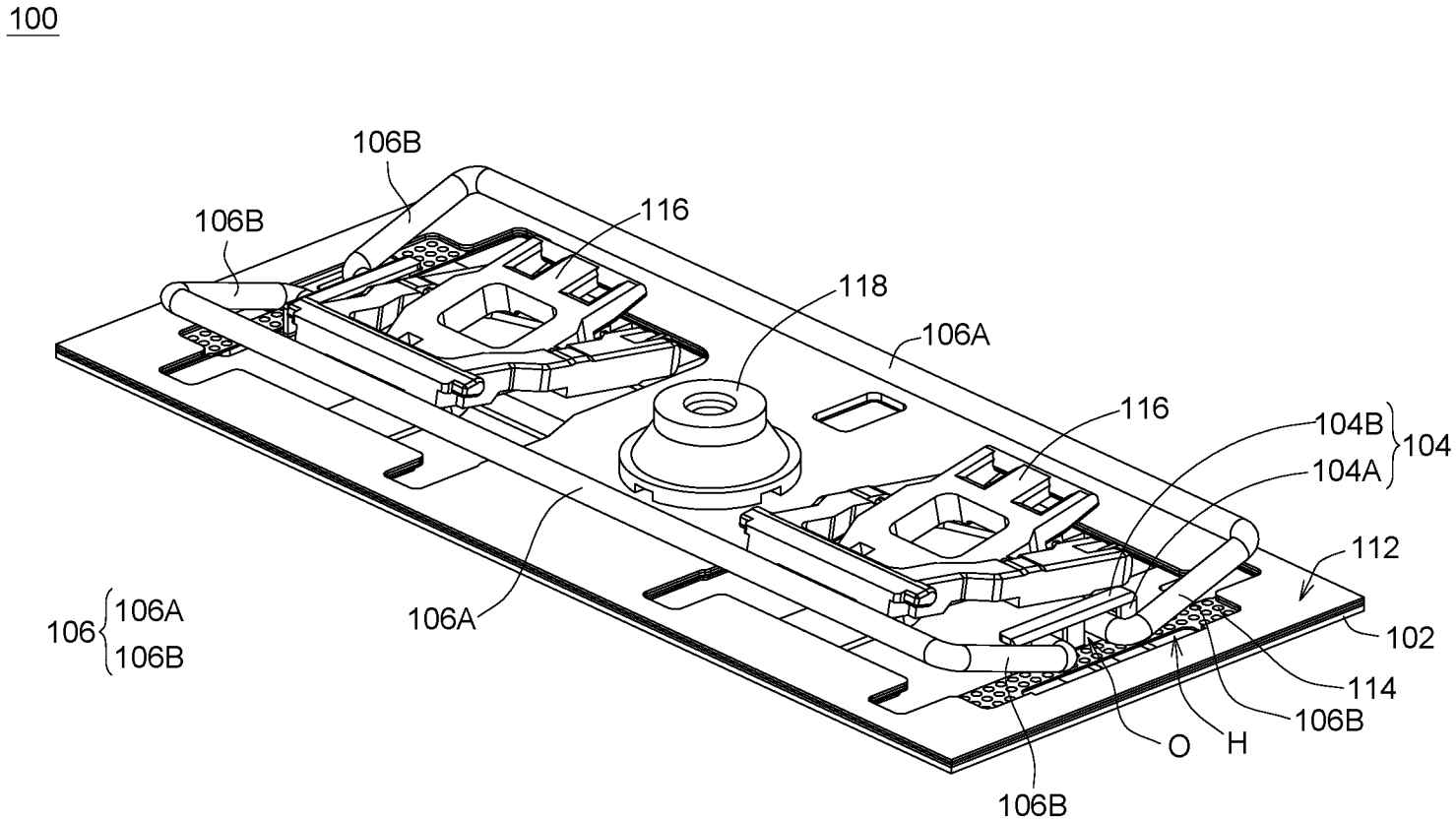
FIG. 1A is a perspective view of the key structure according to an embodiment of the disclosure.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

DETAILED DESCRIPTION

It must be noted that these embodiments and methods are not intended to limit the present invention. The present invention can still be implemented using other features, elements, methods, and parameters. The preferred embodiments are only used to illustrate the technical features of the present invention, and not to limit the scope of the claimed invention. Those with ordinary knowledge in this technical field will be able to make equivalent modifications and changes based on the description in the following specification without departing from the spirit of the present invention. In the different embodiments and drawings, the same or similar elements will be represented by the same or similar reference signs.

In addition, the ordinal numbers used in the specification and claims, such as the terms "first", "second", "third", etc., are used to modify the elements of the claims, and they do not imply or represent that the elements have any ordinal numbers, do not represent the order of a certain element and another element, or the order in the manufacturing method. The use of these ordinal numbers is only to distinguish one element with a certain name from another element with the same name.

Figure 1B:
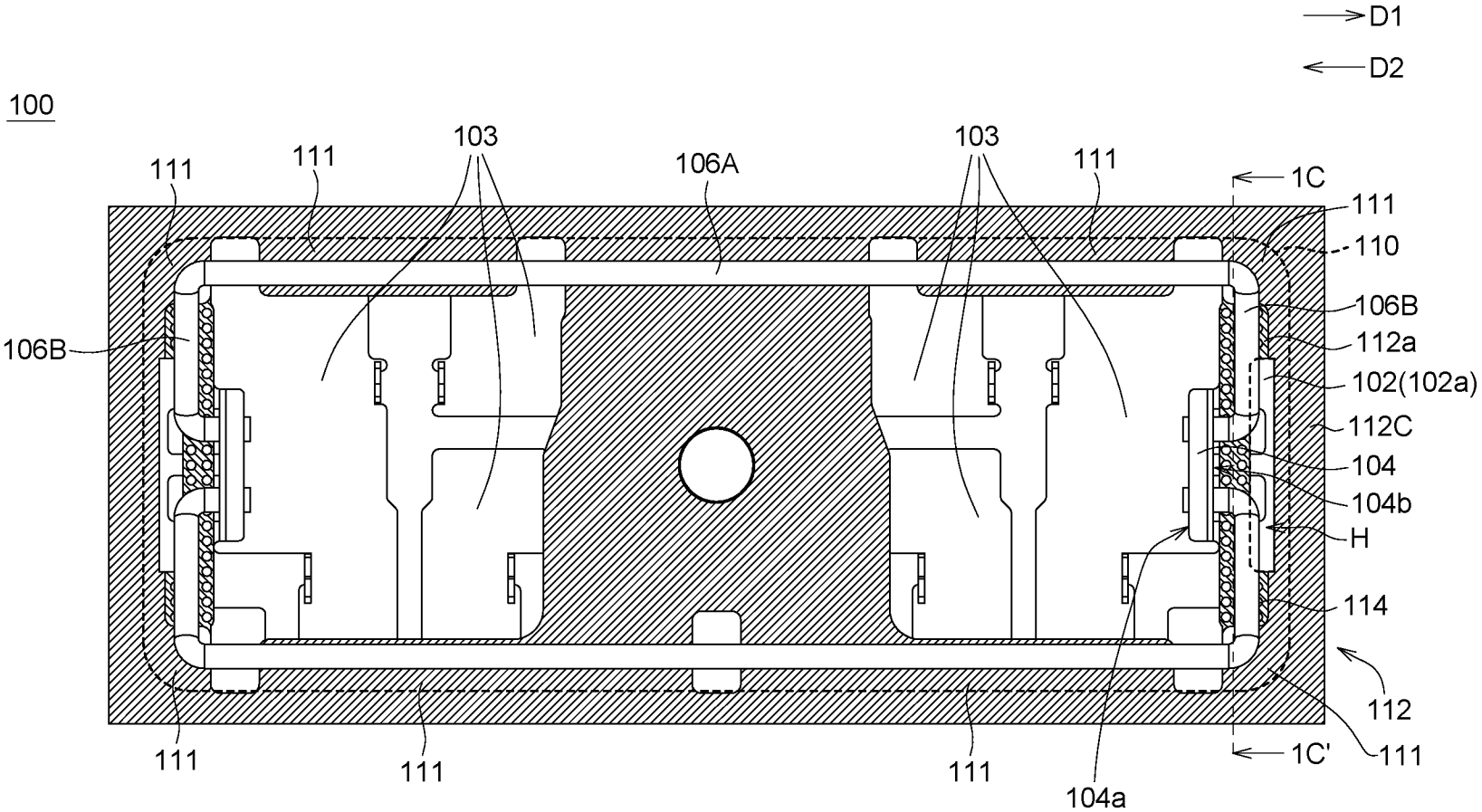
FIG. 1B is a top view of the key structure according to an embodiment of the disclosure.
Figure 1C:
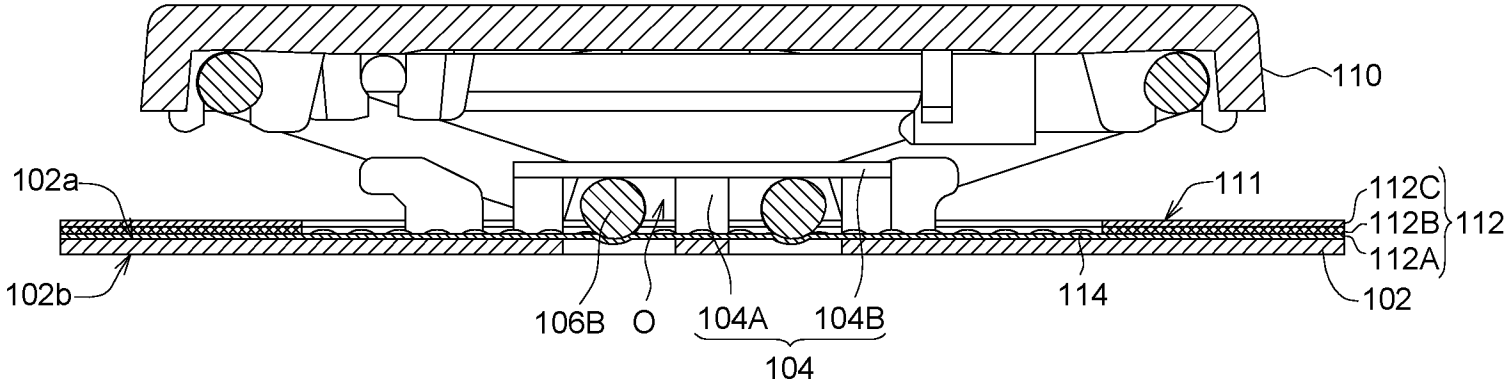
FIG. 1C is a cross-sectional view of the key structure of FIG. 1B along the line 1C-1C'.

FIG. 1A is a perspective view of a key structure 100 according to an embodiment of the disclosure. FIG. 1B is a top view of the key structure 100 according to an embodiment of the disclosure. FIG. 1C is a cross-sectional view of the key structure 100 of FIG. 1B along the line 1C-1C'. In order to clearly express the features of the key structure 100 of the present invention, the key cap 110 is omitted in FIG. 1A, and the key cap 110, the support structure 116 and the elastic body 118 are omitted in FIG. 1B.

Referring to FIGS. 1A, 1B and 1C, the key structure 100 may include a base plate 102, a membrane switch circuit 112, a support structure 116, an elastic body 118, a key cap 110, a balance bar 106, and at least a protruding part 114. For example, the key structure 100 can be any key in a desktop keyboard or a keyboard of a portable computer, such as a space key, a shift key, or a tab key etc., and can also be a letter key, a number key, or a function key. The key cap 110 is disposed on the support structure 116, the balance bar 106 and the elastic body 118, and the support structure 116, the balance bar 106 and the elastic body 118 are movably disposed between the key cap 110 and the base plate 102. Therefore, the key cap 110 can be pressed by the user to move up and down relative to the base plate 102 by the support structure 116, the balance bar 106 and the elastic body 118. In addition, when the key cap 110 is pressed, the membrane switch circuit 112 corresponding to the elastic body 118 is pressed and electrically conducted to generate a pressing signal.

Referring to FIG. 1B, the dashed line (indicated at 110) represents the overlap range of the key cap 110 and the membrane switch circuit 112 in the orthographic projection direction, and the opaque area 111 is included in the overlapped range. In this embodiment, the opaque area 111 is arranged on the top layer of the membrane switch circuit 112 and is located around the hole 103 of the base plate 102. With the above-mentioned arrangement relationship, the light leakage can be reduced. It is worth mentioning that the opaque area 111 may also extend from the periphery of the hole in the base plate 102 to another key cap. In this embodiment, the opaque area 111 is printed or coated on the top layer of the membrane switch circuit 112 with an opaque material, for example. In FIG. 1B, the range of the opaque area 111 is indicated by inclined lines (slash), and the area outside the inclined lines can be the light transmitting area where the backlight module (not shown) emits light to the key cap 110 and the opening area that is used for the supporting structure 116 installed on the base plate 102, but the inclined line is not limited to the opaque area 111. In this embodiment, since the key cap 110 and the membrane switch circuit 112 have an opaque area 111 in the overlap range, the light can be prevented from emitting through the gap between the key cap 110 and the membrane switch circuit 112, so as to improve the light leakage problem of the light-emitting keyboard structure.

Referring to FIG. 1C, the base plate 102 includes a first surface 102*a* facing the key cap 110 and a second surface 102*b* opposite to the first surface 102*a*. The membrane switch circuit 112 is arranged on the base plate 102. The key cap 110 is disposed above the base plate 102 and the membrane switch circuit 112.

Referring to FIGS. 1B and 1C, the balance bar 106 may include a rod body 106A and a first link part 106B. The rod body 106A is connected to the key cap 110, and the first link part 106B extends from both ends of the rod body 106A. The end of the first link part 106B can pass through the mounting portion 104 of the base plate 102 so that the balance bar 106 is pivotally connected to the base plate 102. The balance bar 106 can maintain the left and right balance of the key cap 110 when the key cap 110 moves up and down relative to the base plate 102.

Referring to FIG. 1C, in detail, the mounting portion 104 includes, for example, three upright walls 104A extending upward from the first surface 102*a*, and an extending wall 104B disposed on the top of the upright walls 104A and extending parallel to the first surface 102*a*. One of the openings O is correspondingly formed between two adjacent upright walls 104A and the extending wall 104B, and one end of each first link part 106B can pass through the corresponding one of the openings O, so that the balance bar 106 can be pivotally connected to the base plate 102. The quantity of the mounting portions 104 and the openings O of the base plate 102 can be configured corresponding to the quantity of the first link parts 106B. For example, the key structure 100 includes two balance bars 106 and four first link parts 106B, so that four openings O can be provided correspondingly.

The height of the openings O (that is, the height between the extending wall 104B and the first surface 102*a*) may be similar to or greater than the diameter of the first link part 106B. For example, the diameter of the first link part 106B may be about 0.80 mm, and the height of the opening O may be between about 0.81 mm and about 0.85 mm, but the present disclosure is not limited thereto.

Referring to FIGS. 1B and 1C, the protruding part 114 may be disposed on the membrane switch circuit 112 and located below the first link part 106B, so that when the key cap 110 moves between the pressed position and the unpressed position, the first link part 106B rotates toward the base plate 102, the first link part 106B abuts against the protruding part 114. Since the balance bar 106 is directly connected to the base plate 102, when the key cap 110 is pressed to move the balance bar 106 downward, the balance bar 106 will collide with the base plate 102 and generate unnecessary impact noise. In this embodiment, the protruding part 114 can be used as a buffer to reduce the impact noise generated by the first link part 106B of the balance bar 106 relative to the base plate 102.

Figure 1E:
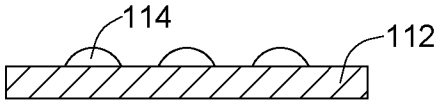
FIG. 1E shows an embodiment of multiple protruding parts.
Figure 1D:
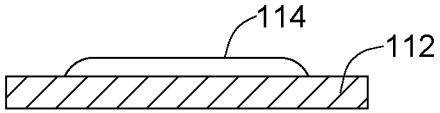
FIG. 1D is an embodiment of single protruding part.

Referring to FIG. 1D and FIG. 1E, the quantity of the protruding part 114 may be one or more. When one protruding part 114 is provided on the membrane switch circuit 112, the protruding part 114 can be formed in a strip or a sheet, and when multiple protruding parts 114 are provided on the membrane switch circuit 112, the protruding parts 114 can be formed in an array of dots.

Referring to FIG. 1B. For example, the protruding part 114 is an elastic bump, and the height of the protruding part 114 is greater than 0.01 mm, preferably between 0.01 mm and 0.05 mm, or preferably between 0.03 mm and 0.05 mm, so that when the first link part 106B rotates toward the base plate 102 and abuts against the protruding part 114, good impact absorption and sound absorption effect are provided. In addition, referring to FIG. 1C, the abutting position of the first link part 106B and the membrane switch circuit 112 is, for example, arranged between two adjacent protruding parts 114, so that the first link part 106B is limited by the adjacent two protruding parts 114 to reduce the lateral displacement or vibration noise of the first link part 106B on the membrane switch circuit 112. Therefore, the protruding parts 114 have the functions of buffer, sound absorption and positioning.

According to the above-mentioned embodiment of the present disclosure, since a plurality of protruding parts 114 are provided between the balance bar 106 and the membrane switch circuit 112, the ends of the first rod 106B can be respectively held between two adjacent protruding parts 114. Therefore, by the interference of the protruding parts 114, the pivot tolerance between the end of the first link part 106B and the opening O of the mounting portion 104 can be reduced, thereby increasing the amount of interference to achieve the technical effects of anti-noise and positioning. The protruding part 114 can be formed by, for example, a hot press molding or a glue dispensing method, which is not limited in the present invention.

Referring to FIGS. 1B and 1C, the membrane switch circuit 112 includes, for example, a first circuit layer 112A, an insulating layer 112B, and a second circuit layer 112C. The first circuit layer 112A is disposed on the base plate 102, the insulating layer 112B is disposed on the first circuit layer 112A, and the second circuit layer 112C is disposed on the insulating layer 112B. In detail, the insulating layer 112B is arranged between the first circuit layer 112A and the second circuit layer 112C, and the first circuit layer 112A, the insulating layer 112B, and the second circuit layer 112C are stacked on from top to each other. Although not disclosed in the drawings, it is conceivable that an adhesive layer is connected between the first circuit layer 112A and the insulating layer 112B, and another adhesive layer is connected between the second circuit layer 112C and the insulating layer 112B. The first circuit layer 112A and the second circuit layer 112C are separated by a predetermined distance to form a key switch between the first circuit layer 112A and the second circuit layer 112C.

The membrane switch circuit 112 is arranged on the base plate 102 to transmit the pressing signal of the key structure 100. In detail, when the key cap 110 is pressed, the membrane switch circuit 112 corresponding to the elastic body 118 is pressed, so that the first circuit layer 112A and the second circuit layer 112C of the membrane switch circuit 112 are in contact with each other to conduct the key switch and a pressing signal is generated accordingly.

Referring to FIG. 1B, the membrane switch circuit 112 is provided with a hole H in the overlap range, the hole H penetrates the first circuit layer 112A, and the hole H exposes a part of the first surface 102*a* of the base plate 102. However, the membrane switch circuit 112 of the present disclosure can be appropriately changed and adjusted depending on the actual application, and is not limited to the aspect shown in FIG. 1B. In the embodiment, the opaque area 111 is located around the hole H of the membrane switch circuit 112.

Referring to FIG. 1B, the membrane switch circuit 112 may include an extension plate 112*a*, the extension plate 112*a* is located below the first link part 106B, and the protruding parts 114 may be disposed on the extension plate 112*a* to reduce the impact noise of the first link part 106B of the balance bar 106 with respect to the base plate 102. The extension plate 112*a* is located between the hole H and the mounting portion 104, or if the hole H is not required, the extension plate 112*a* can extend in the first direction D1 and cover the hole H, so that the first surface 102*a* of the base plate 102 is not required to be exposed. In another embodiment, the extension plate 112*a* may extend in the second direction D2, so that the extension plate 112*a* can be aligned with the inner side wall 104*a* or the outer side wall 104*b* of the mounting portion 104.

Figure 2A:
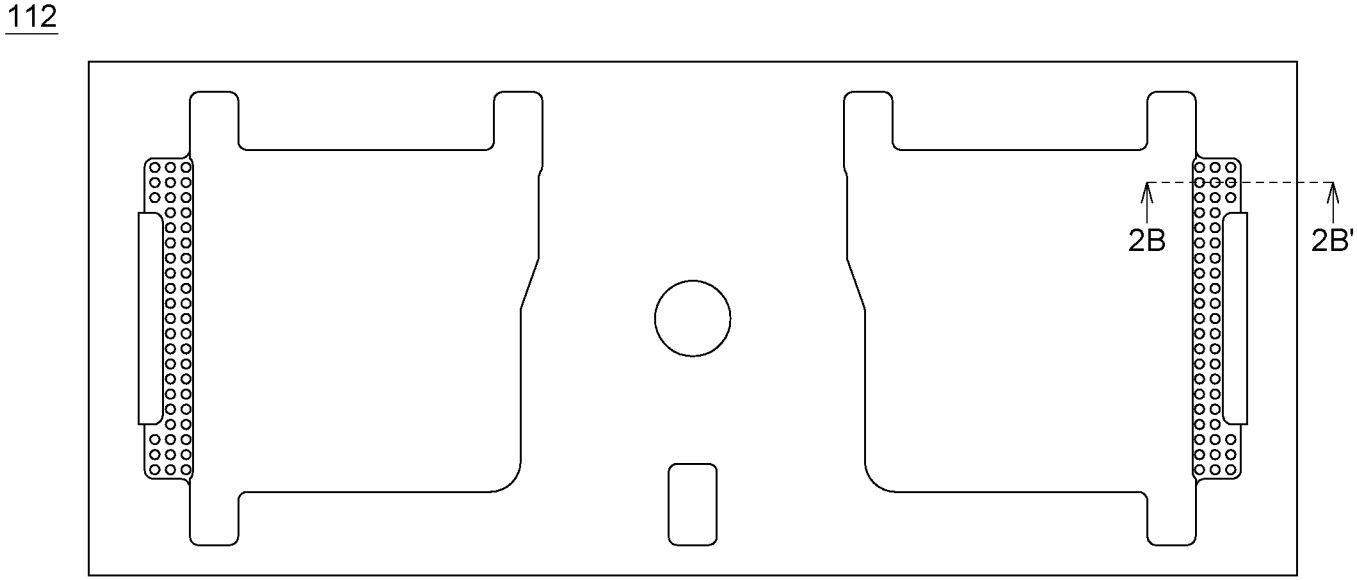
FIG. 2A is a schematic top view of a membrane switch circuit according to an embodiment of the disclosure.
Figure 2B:
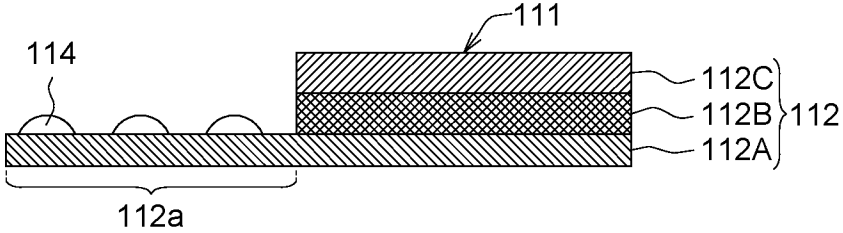
FIG. 2B is a cross-sectional view of the membrane switch circuit of FIG. 2A along the line 2B-2B'.

FIG. 2A is a schematic top view of the membrane switch circuit 112 according to an embodiment of the disclosure. FIG. 2B is a cross-sectional view of the membrane switch circuit 112 of FIG. 2A along the line 2B-2B'. As shown in FIGS. 2A and 2B, multiple protruding parts 114 are provided on the first circuit layer 112A. In detail, the protruding parts 114 may be disposed on the extension plate 112*a* of the first circuit layer 112A. The extension plate 112*a* does not overlap with the insulating layer 112B and the second circuit layer 112C in the orthographic projection direction.

Figure 3A:
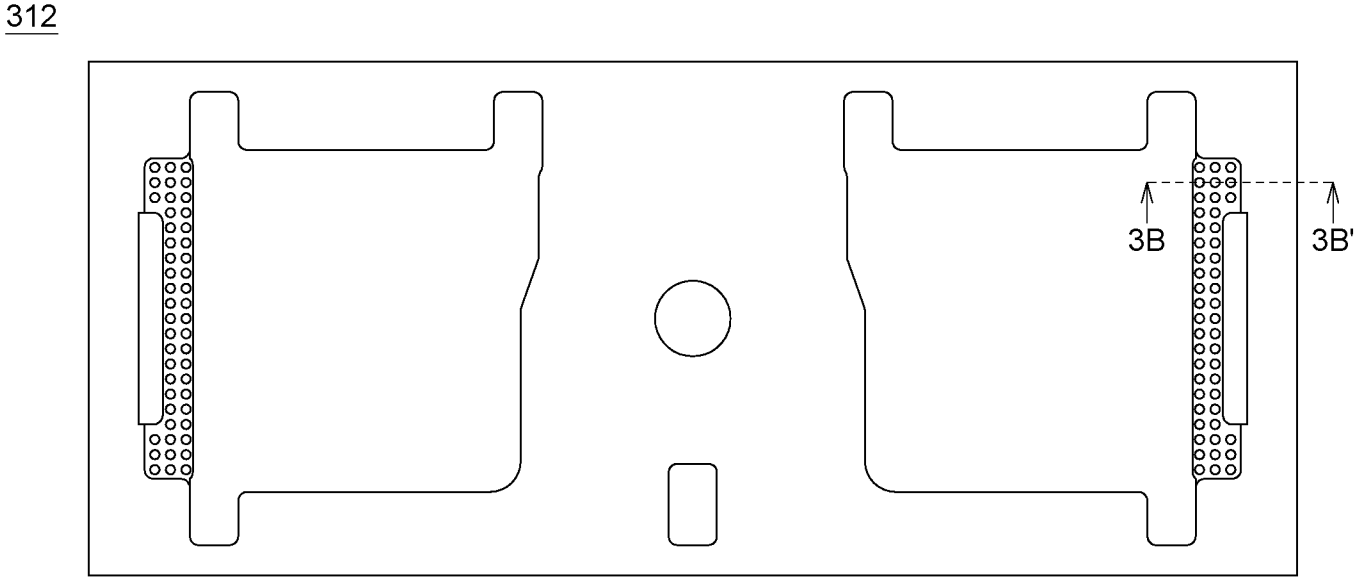
FIG. 3A is a schematic top view of a membrane switch circuit according to an embodiment of the disclosure.
Figure 3B:
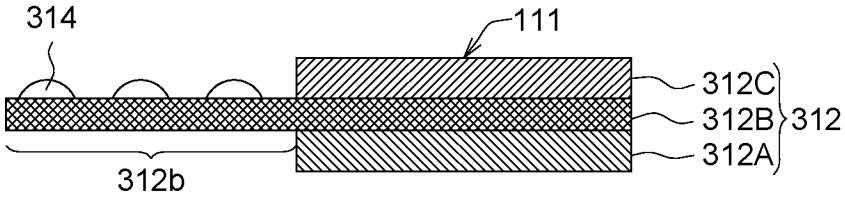
FIG. 3B is a cross-sectional view of the membrane switch circuit of FIG. 3A along the line 3B-3B'.

FIG. 3A is a schematic top view of the membrane switch circuit 312 according to an embodiment of the disclosure. FIG. 3B is a cross-sectional view of the membrane switch circuit 312 of FIG. 3A along the line 3B-3B'. As shown in FIGS. 3A and 3B, the membrane switch circuit 312 may include a first circuit layer 312A, an insulating layer 312B, and a second circuit layer 312C, and a plurality of protruding parts 314 is disposed on the insulating layer 312B. In detail, the protruding parts 314 may be disposed on an extension plate 312*b* of the insulating layer 312B. The extension plate 312*b* does not overlap with the first circuit layer 312A and the second circuit layer 312C in the orthographic projection direction. In this embodiment, the same or similar reference signs are used for the same or similar components in the above-mentioned embodiments, and the related description of the same or similar components have been recited in the foregoing embodiments, and will not be repeated here.

Figure 4A:
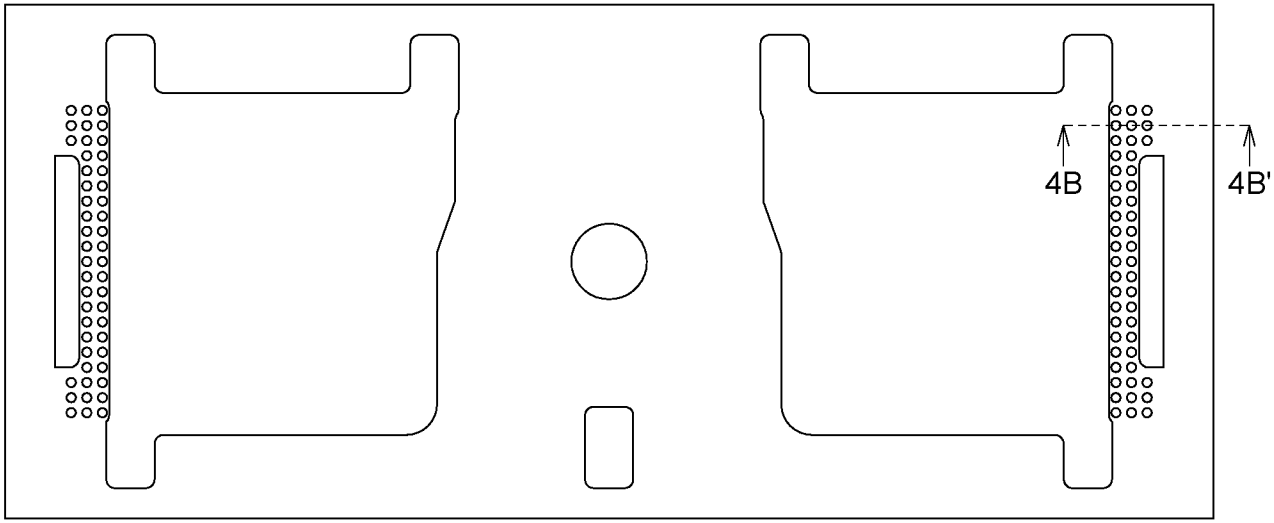
FIG. 4A is a schematic top view of a membrane switch circuit according to an embodiment of the disclosure.
Figure 4B:
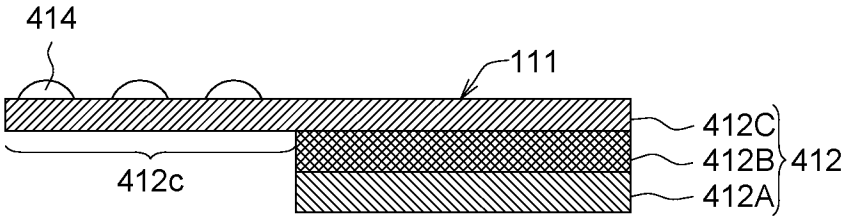
FIG. 4B is a cross-sectional view of the membrane switch circuit of FIG. 4A along the line 4B-4B'.

FIG. 4A is a schematic top view of a membrane switch circuit 412 according to an embodiment of the disclosure. FIG. 4B is a cross-sectional view of the membrane switch circuit 412 of FIG. 4A along the line 4B-4B'. The membrane switch circuit 412 may include a first circuit layer 412A, an insulating layer 412B, and a second circuit layer 412C, and a plurality of protruding parts 414 is disposed on the second circuit layer 412C. In detail, the protruding parts 414 may be disposed on an extension plate 412*c* of the second circuit layer 412C, and the extension plate 412*c* does not overlap with the first circuit layer 412A and the insulating layer 412B in the orthographic projection direction. In this embodiment, the same or similar reference signs are used for the same or similar components in the above-mentioned embodiments, and the related description of the same or similar components have been recited in the foregoing embodiments, and will not be repeated here.

Figure 5A:
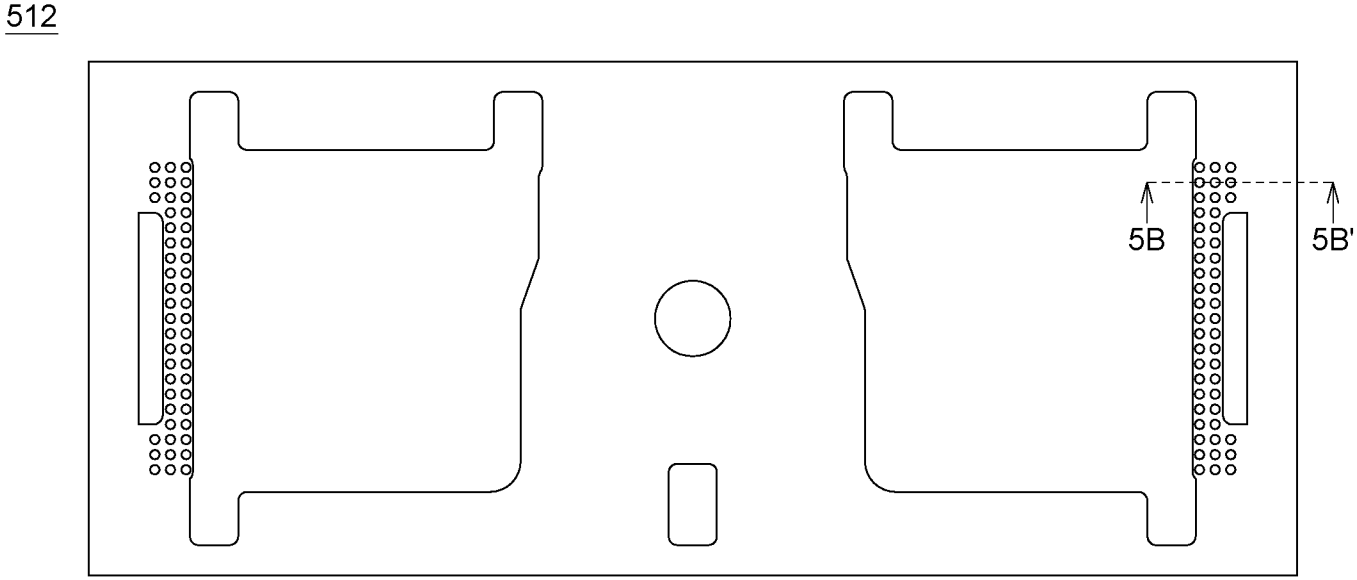
FIG. 5A is a schematic top view of a membrane switch circuit according to an embodiment of the disclosure.
Figure 5B:
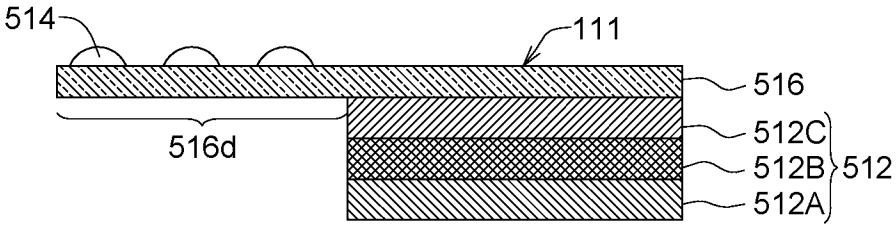
FIG. 5B is a cross-sectional view of the membrane switch circuit of FIG. 5A along the line 5B-5B'.

FIG. 5A is a schematic top view of a membrane switch circuit 512 according to an embodiment of the disclosure. FIG. 5B is a cross-sectional view of the membrane switch circuit 512 of FIG. 5A along the line 5B-5B'. The membrane switch circuit 512 may include a first circuit layer 512A, an insulating layer 512B, and a second circuit layer 512C, and a plurality of protruding parts 514 is disposed on the covering layer 516. In detail, the protruding parts 514 may be disposed on an extension plate 516*d* of the cover layer 516, and the extension plate 516*d* does not overlap with the first circuit layer 512A, the insulating layer 512B, and the second circuit layer 512C in the orthographic projection direction. The cover layer 516 is disposed on the membrane switch circuit 512, and the opaque area 111 can also be printed or coated on the cover layer 516, and it is not limited to be directly coated on the membrane switch circuit 512. In detail, the cover layer 516 is disposed on the second circuit layer 512C. The covering layer 516 may include a polyester film, such as mylar, but the disclosure is not limited thereto. In this embodiment, the same or similar reference signs are used for the same or similar components in the above-mentioned embodiments, and the related description of the same or similar components have been recited in the foregoing embodiments, and will not be repeated here.

According to the embodiment of the present disclosure, since the protruding parts 514 only need to be formed on the cover layer 516 that is additionally attached to the membrane switch circuit 512, there is no need to perform special processing on the membrane switch circuit 512 to make the protruding parts 514, thereby it has the technical advantages of reducing process failure rate and improving process quality.

In another embodiment, the above-mentioned extension plate may also be formed by at least two films among the first circuit layer, the insulating layer, and the second circuit layer, or by at least two films among the first circuit layer, the insulating layer, the second circuit layer and the cover layer, which is not limited in the present invention.

Figure 6:
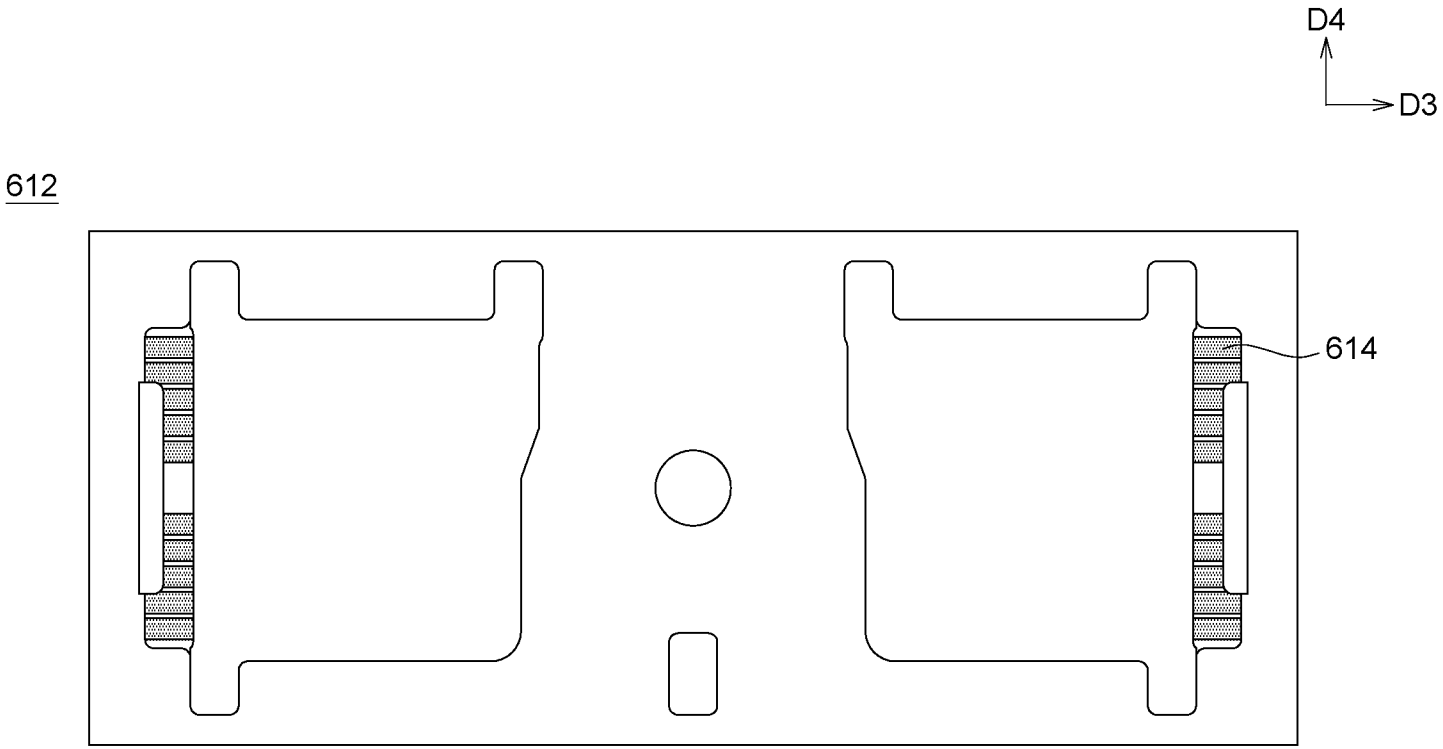
FIG. 6 is a schematic top view of a membrane switch circuit according to an embodiment of the disclosure.
Figure 7:
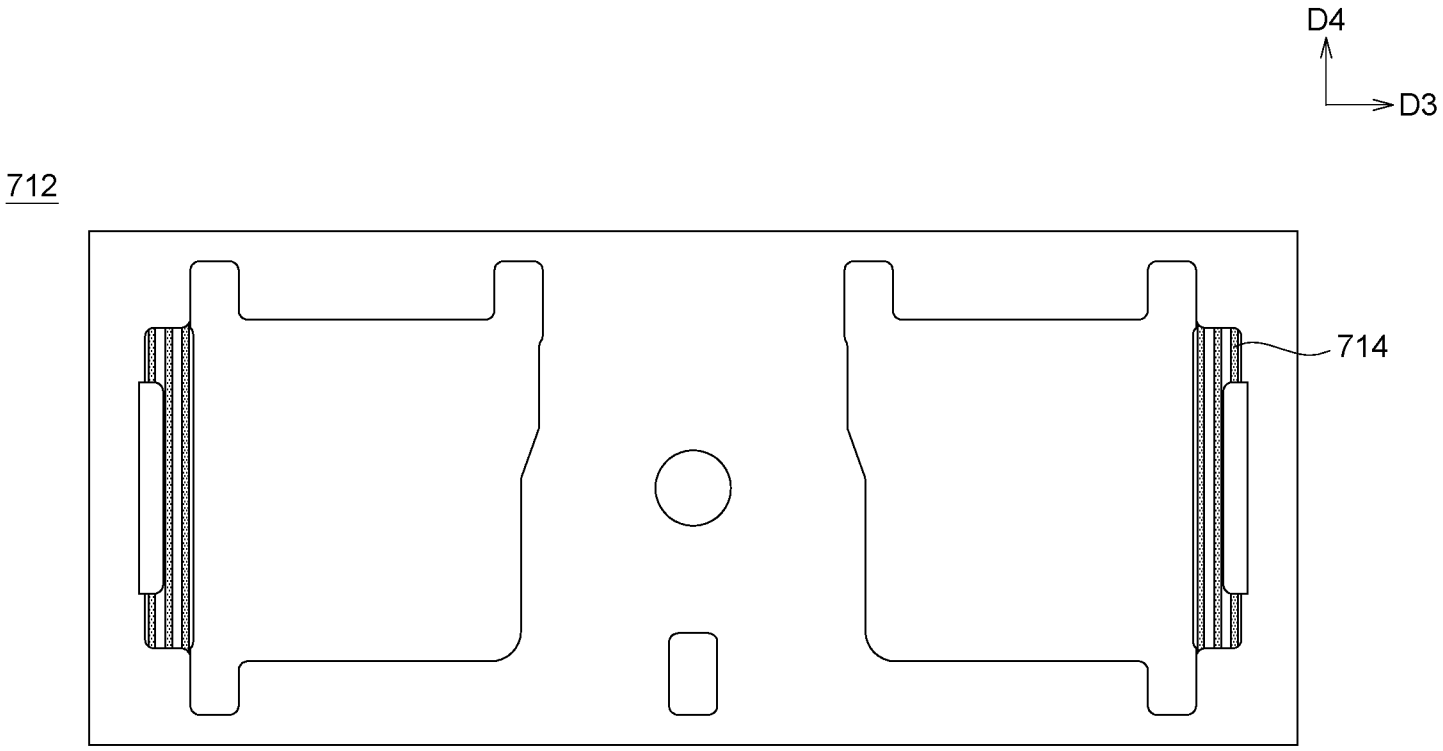
FIG. 7 is a schematic top view of a membrane switch circuit according to an embodiment of the disclosure.

FIG. 6 is a schematic top view of a membrane switch circuit 612 according to an embodiment of the disclosure. FIG. 7 is a schematic top view of a membrane switch circuit 712 according to an embodiment of the disclosure. As shown in FIGS. 6 and 7, the main difference between the membrane switch circuits 612 and 712 of the two embodiments and the membrane switch circuit 112 of the embodiment shown in FIG. 2A is that the protruding parts 614 and the protruding parts 714 are arranged in strips. In detail, the protruding parts 614 extend in the third direction D3, and the protruding parts 714 extend in the fourth direction D4. The third direction D3 may be substantially perpendicular to the fourth direction D4, and the third direction D3 is substantially the same as the extension direction of the rod body 106A in FIG. 1B, and the fourth direction D4 is substantially the same as the extension direction of the first link part 106B in FIG. 1B. In this embodiment, the same or similar reference signs are used for the same or similar components in the above-mentioned embodiments, and the related description of the same or similar components have been recited in the foregoing embodiments, and will not be repeated here.

Of course, the protruding parts of the disclosure can be appropriately changed and adjusted depending on the actual application, and is not limited to the aspect shown in FIG. 2A, FIG. 6 and FIG. 7. The protruding parts of the disclosure may also be ring-shaped, zigzag-shaped, corrugated, or other suitable shapes.

It will be apparent to those skilled in the art that various modifications and variations can be made to the disclosed embodiments. It is intended that the specification and examples be considered as exemplary only, with a true scope of the disclosure being indicated by the following claims and their equivalents.

What is claimed is:

1. A key structure, comprising:

a base plate comprising a mounting portion;

a membrane switch circuit arranged on the base plate;

a key cap disposed above the membrane switch circuit;

a balance bar arranged between the base plate and the key cap, the balance bar comprises a rod body and a first link part, the rod body is connected to the key cap, and the first link part is pivotally arranged corresponding to the mounting portion and connected to the base plate; and a protruding part protruding from the membrane switch circuit toward the first link part, wherein the protruding part is arranged on the membrane switch circuit and located below the first link part so that the first link part abuts against the protruding part, wherein, an opaque area is formed in an overlap range of an orthographic projection of the membrane switch circuit and the key cap.

2. The key structure according to claim 1, wherein the membrane switch circuit comprises:

a first circuit layer;

an insulating layer arranged on the first circuit layer; and a second circuit layer arranged on the insulating layer.

3. The key structure according to claim 2, wherein the protruding part is located on the first circuit layer.

4. The key structure according to claim 2, wherein the protruding part is located on the second circuit layer.

5. The key structure according to claim 2, wherein the protruding part is located on the insulating layer.

6. The key structure according to claim 1, wherein the key structure further comprises a covering layer disposed on the membrane switch circuit.

7. The key structure according to claim 6, wherein the protruding part is located on the covering layer.

8. The key structure according to claim 1, wherein a height of the protruding part is between 0.01 mm and 0.05 mm.

9. The key structure according to claim 1, wherein a height of the protruding part is between 0.03 mm and 0.05 mm.

10. The key structure according to claim 1, wherein the opaque area is formed on a top layer of the membrane switch circuit.

11. The key structure according to claim 1, wherein the base plate has a hole in the overlap range, and the opaque area is located around the hole of the base plate.

12. The key structure according to claim 1, wherein the membrane switch circuit comprises an extension plate, the extension plate is located below the first link part, and the protruding part is disposed on the extension plate.

13. The key structure according to claim 12, wherein the membrane switch circuit has a hole in the overlap range, and the extension plate extends from the hole to the mounting portion.

14. The key structure according to claim 1, wherein the membrane switch circuit has a hole in the overlap range, and the opaque area is located around the hole of the membrane switch circuit.

15. The key structure according to claim 1, wherein the protruding part is formed in a strip, a sheet or a dot.

* * * * *